US005416946A

United States Patent [19]

Brown et al.

[11] Patent Number: 5,416,946

[45] Date of Patent: May 23, 1995

[54] SOOTBLOWER HAVING VARIABLE DISCHARGE

[75] Inventors: Clinton A. Brown, Baltimore; Sean Kling, Dublin, both of Ohio

[73] Assignee: The Babcock & Wilcox Company, New Orleans, La.

[21] Appl. No.: 232,322

[22] Filed: Apr. 25, 1994

Related U.S. Application Data

[63] Continuation of Ser. No. 31,577, Mar. 15, 1993, abandoned, which is a continuation-in-part of Ser. No. 877,641, May 1, 1992, Pat. No. 5,237,718, and Ser. No. 877,987, May 2, 1992, Pat. No. 5,337,438.

[51] Int. Cl.[6] ..... F23J 3/00

[52] U.S. Cl. ..... 15/318; 15/318.1; 122/390; 122/392

[58] Field of Search ..... 15/316.1, 317, 318, 15/318.1; 122/390, 392

[56] References Cited

U.S. PATENT DOCUMENTS

| | | | |
|---|---|---|---|
| Re. 32,517 | 10/1987 | Nelson . | |
| 2,883,694 | 4/1959 | Hibner et al. . | |
| 3,230,568 | 1/1966 | Saltz . | |
| 3,344,459 | 10/1967 | Jankowski . | |
| 3,593,691 | 7/1971 | Wirths et al. . | |
| 3,701,341 | 10/1972 | Willis, Jr. . | |
| 3,782,336 | 1/1974 | Nelson . | |
| 4,380,843 | 4/1983 | Sullivan et al. | 15/316.1 |
| 4,387,481 | 6/1983 | Zalewski | 15/316.1 |
| 4,437,201 | 3/1984 | Zalewski . | |
| 4,492,187 | 1/1985 | Hammond . | |
| 4,527,515 | 7/1985 | Hester, II . | |
| 4,718,376 | 1/1988 | Leroueil et al. . | |
| 4,803,959 | 2/1989 | Sherrick et al. . | |
| 4,905,900 | 3/1990 | Scharton et al. | 15/316.1 X |
| 5,063,632 | 11/1991 | Clark et al. | 15/316.1 |
| 5,181,482 | 1/1993 | Labbe et al. . | |
| 5,320,073 | 1/1994 | Silcott et al. . | |

*Primary Examiner*—Chris K. Moore
*Attorney, Agent, or Firm*—Harness, Dickey & Pierce

[57] ABSTRACT

A retractable sootblower for use in cleaning heat exchanger surfaces during a single stroke of its operating cycle. A control system is utilized to vary the rate at which the blowing medium is discharged from the lance tube into the heat exchanger. The rate of discharge is greater during the cleaning stroke of the lance tube than during the non-cleaning stroke.

20 Claims, 3 Drawing Sheets

SOOTBLOWER HAVING VARIABLE DISCHARGE

CROSS REFERENCE TO THE RELATED APPLICATION

This is a continuation division of U.S. patent application Ser. No. 08/031,577, filed Mar. 15, 1993 entitled Sootblower Having Variable Discharge, now abandoned, which is a continuation-in-part of application Ser. No. 07/877,641 , filed May 1, 1992, and entitled "Sootblower With Lance Bypass Flow", issued as U.S. Pat. No. 5,237,718, issued on Aug. 24, 1993, and is also a continuation-in-part of application Ser. No. 07/877,987, now U.S. Pat. No. 5,337,438, issued Aug. 16, 1994, and entitled "Method and Apparatus for Constant Progression of a Cleaning Jet Across Heated Surfaces" , filed May 2, 1992.

BACKGROUND AND SUMMARY OF THE INVENTION

This invention relates generally to a sootblower device for directing a fluid spray against a heat exchanger surface for cleaning the heat exchanger surface and in particular to a sootblower device having variable translational and rotational speeds along with a variable discharge of blowing medium to optimize the application of the blowing medium against the heat exchange surfaces while decreasing the time for completion of the operating cycle.

Cleaning highly heated surfaces, such as the surfaces of a boiler, furnace, incinerators or the like used to extract heat, has commonly been performed by devices generally known as sootblowers. Sootblowers typically employ water, steam, air or a combination thereof as a blowing medium which is directed through one or more nozzles against encrustations of slag, ash, scale and/or other foul materials which become deposited on the heat exchanger surfaces. Throughout the specification claims, the term "heat exchanger" is broadly used to refer to boilers, furnaces, incinerators or the like having internal surfaces in need of periodic cleaning to remove encrustations.

It is known that water in liquid form, either used alone or in combination with a gaseous blowing medium, increases the ease with which the encrustations are dislodged. The effectiveness of water in dislodging the encrustations results from a thermal shock effect coupled with mechanical impact. The thermal shock shrinks and embrittles the encrustations resulting in a fracturing of the encrustations so that they become dislodged and fall away from the heat exchanger surfaces because of the mechanical impact.

Various types of sootblowers have been developed for cleaning heat exchanger surfaces. One type of sootblower is known as the retracting variety which employs a lance tube that is advanced into a heat exchanger through a wall port. The lance tube has one or more nozzles through which the cleaning or blowing medium is discharged and sprayed against the heat exchanger surfaces. After a cleaning cycle has been completed the lance tube is retracted from the heat exchanger until cleaning is again needed. During each cleaning cycle, in addition to being advanced and retracted into and from the boiler, the lance tube is often rotated so that the spray of blowing medium is directed along a spiral path against the heat exchanger surfaces. Retractable sootblowers are used in applications where the internal temperatures of the heat exchanger are sufficient to damage the lance tube and shorten its life if permanently installed in the heat exchanger. Other sootblowers employ a permanently positioned lance tubes which, during each cleaning cycle, may be rotated or rotationally oscillated back and forth to move the jet stream of the blowing medium.

Unfortunately, to obtain sufficient cleaning with the water spray process mentioned above, a danger of over stressing the hot heat exchanger surfaces is present. Rapid deterioration of the heat exchanger surfaces as a result of thermal shock from the cleaning process has been observed. The problem of heat exchanger surface deterioration has been particularly severe in connection with cleaning the rigidly held tube bundles of large scale boilers. Being rigidly held, the tubes can not readily distort in response to the temperature induced shrinkage and expansion occurring during a cleaning cycle. The potential for damage to the heat exchanger surfaces is greater if the blowing medium is sprayed against a surface a second time, after it has been recently cleaned, such that the blowing medium contacts the surface directly rather than contacting an encrustation on the surface. Such multiple cleanings of a surface can occur where the jet stream from two adjacent sootblowers overlap one another. As a result, during the cleaning portion of the operating cycle it is desirable to periodically terminate the flow of the blow medium from the sootblower where the jet stream will cover a previously cleaned surface.

During certain other portions of the cleaning cycle, the jet stream will not be directed toward a heat exchanger surface in need of cleaning. One such situation is during the retraction stroke of the lance tube when cleaning has been performed during the insertion stroke of the lance tube (or vice versa). In this situation, during the retraction stroke of the lance tube, the discharging of the blowing medium is not desirable since it results in unnecessary blowing medium consumption. It is also desirable to avoid the needless discharge of blowing medium into the heat exchanger since this places an unnecessary thermal load on the heat exchanger and decreases efficiency. Another situation encountered is where during rotation of the sootblower lance tube, the emitted jet of blowing medium strikes surfaces to be cleaned over one or more arcs which combined are less than a full rotation of the jet. In other words, the jet is not performing a cleaning function during medium discharge over one or more portions of the rotational movement of the sootblower lance would reduce unneeded blowing medium discharge.

In terminating or reducing the discharge of the blowing medium, however, it is not always possible or practical to entirely eliminate the flow of the blowing medium. For example, it may be necessary to maintain a minimum flow rate through the lance tube in order to provide cooling of the lance tube within the heat exchanger. This will result in less wear on the heat exchange surfaces.

In additional to controlling the rate of blowing medium discharge, controlling the speed of the lance tube (the rate at which the lance tube is inserted, retracted and rotated) both during cleaning and non-cleaning portions of the operating cycle, will optimize the time it takes to complete the operating cycle. This further limits wear on the heat exchange surfaces and the lance tube.

Accordingly, it is an object of the present invention to provide a means for regulating the flow of the blowing medium from the lance tube into the heat exchanger during each cleaning cycle, depending on whether the lance tube nozzles are directed toward a surface which has already been cleaned during that operating cycle, to reduce blowing medium consumption.

It is also an object of the present invention to control, over the course of the operating cycle, the speed at which the lance tube is inserted, retracted and rotated so as to reduce and optimize the duration of the operating cycle.

Another object of this invention is to provide a sootblower in which cleaning is performed solely during either the insertion or retraction stroke of the lance tube while blowing medium discharge and lance tube speed are controlled to optimize the efficiency of the operating cycle.

In one embodiment of the invention, the lance tube is equipped with an inner tube extending therein creating an inner passage within the inner tube and an outer passage between the inner tube and the inner surface of the lance tube. The outer passage is used for supplying the blowing medium to the lance tube while the inner passage is used for return of a portion of the blowing medium for discarding externally of the heat exchanger. By opening the return flow path, the flow or amount of blowing medium being discharged through the lance tube nozzles is controllable based on the relative restriction to flow of the blowing medium through the nozzle as compared to the return flow path. When it is desirable to terminate or at least reduce the flow of the blowing medium through the lance tube nozzles, such as when the discharge would result in double cleaning of a surface or would occur during a non-cleaning portion of the operating cycle, the supply of blowing medium can be reduced to a minimum value necessary for cooling and other purposes. However, to further reduce the discharge of blowing medium through the nozzle, the return flow path is open whereby only a portion of the blowing medium used for cooling, etc. is discharged through the nozzles and into the heat exchanger. The remainder is discharged externally of the heat exchanger.

In the present invention, the speed or rate at which the lance tube is inserted, retracted and/or rotated can be varied. For example, when the nozzles and jets are directed at an already cleaned surface, the rate of rotation and/or translation can be increased to reduce the overall operating cycle time while the discharge rate of the blowing medium is decreased to reduce consumption.

Further objects, features and advantages of the invention will become apparent from a consideration of the following description and the appended claims when taken in connection with the accompanying drawings.

DETAILED DESCRIPTION OF THE INVENTION

Figure 1:
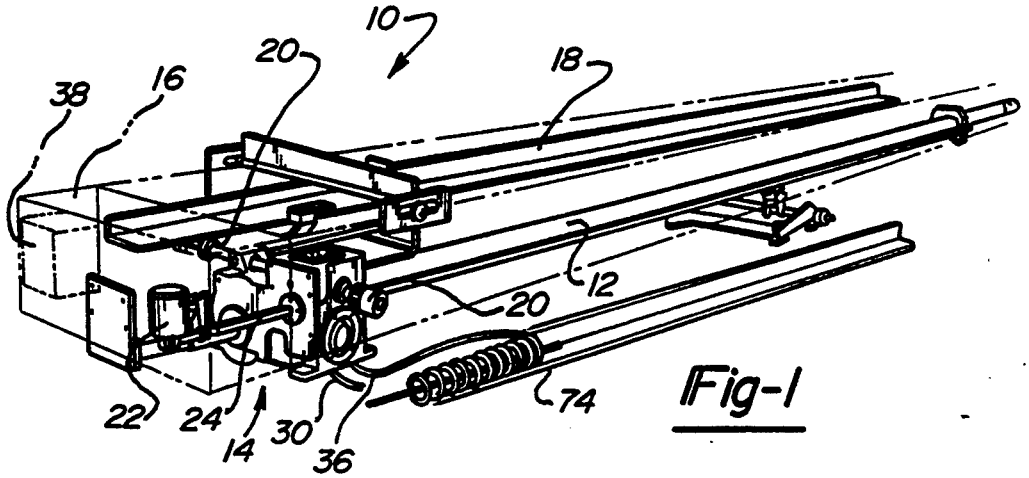
FIG. 1 is a perspective view of a retractable sootblower including the fluid drain from the lance tube of the present invention.

Referring now to the drawings, a sootblower of the present invention is provided to clean heat exchange surfaces during a single pass of the lance tube, either the insertion or retraction stroke. The sootblower is shown having a fluid bypass from the lance tube for use in regulating the flow of the blowing fluid through the lance tube nozzles. A sootblower of the long retracting variety incorporating the features of the present invention is shown in FIG. 1 and designated generally at 10. Sootblower 10 is generally of the type described in U.S. Pat. No. 3,439,376, commonly assigned to the Assignee of this invention and hereby incorporated by reference. Sootblowers of the general variety shown in FIG. 1 are well known within the art. As will become more apparent from the discussion which follows, the principals of the present invention will have applicability to sootblowers in general and are not limited to sootblowers of the retracting variety.

A lance tube 12 is mounted to a carriage assembly 14 and is reciprocally inserted into a heat exchanger to clean surfaces by discharging the blowing medium in a jet stream against the surfaces. The carriage assembly is supported by a frame box 16 which is in turn mounted to a wall box (not shown) of the heat exchanger. The frame box 16 forms a protective housing for the sootblower 10 exteriorly of the heat exchanger. To permit translational motion of the lance tube 12, the carriage assembly 14 travels on rollers (not shown) along a pair of tracks 18 (only one of which is shown) which are rigidly connected to the frame box 16. The tracks 18 include toothed racks which are engaged by pinion gears 20 of the carriage assembly drive train to induce translation of the carriage. A motor 22 is mounted to the frame box and rotates a drive shaft 24 which extends the substantial length of the frame box 16 and passes through the carriage assembly 14. A drive train within the carriage assembly is slidably coupled to the drive shaft 24 so that the carriage assembly is capable of translational movement along the length of the drive shaft. The drive train rotates the pinion gears 20 causing the carriage assembly to translate along the tracks 18 and thereby advance and retract the lance 12 from the heat exchanger depending upon the direction of rotation of the drive shaft 24. In addition, the drive train is also operable to rotate the lance 12 about its longitudinal axis.

A flexible supply hose 30 extends into the bottom of the carriage assembly 14 and supplies the blowing medium to the lance tube 12. A cable carrier 74 is preferably employed to support the length of supply hose 30 necessary to provide for travel of the carriage assembly along the length of the frame box 16. A flexible return hose 36 is coupled to the bottom of the carriage assembly for return of a portion of the blowing medium from the lance tube 12. Return hose 36 is likewise carried by the cable carrier 74 along with the supply hose 30.

A programmable controller 38, which may be a common microprocessor, is coupled to position encoders which provide information to the controller regarding the translational and rotational position of the lance tube 12 and nozzles. The controller 38 is programmed for the specific configuration of the heat exchanger surfaces which are to be cleaned. The controller 38 is operable to control the rotational and translational speeds of the lance tube as well as the supply and return flow of the cleaning medium. The controller 38 thus regulates the amount or rate at which cleaning medium is discharged from the lance tube into the heat exchanger and the length of time it takes for the sootblower to complete an entire operating cycle.

Figure 2:
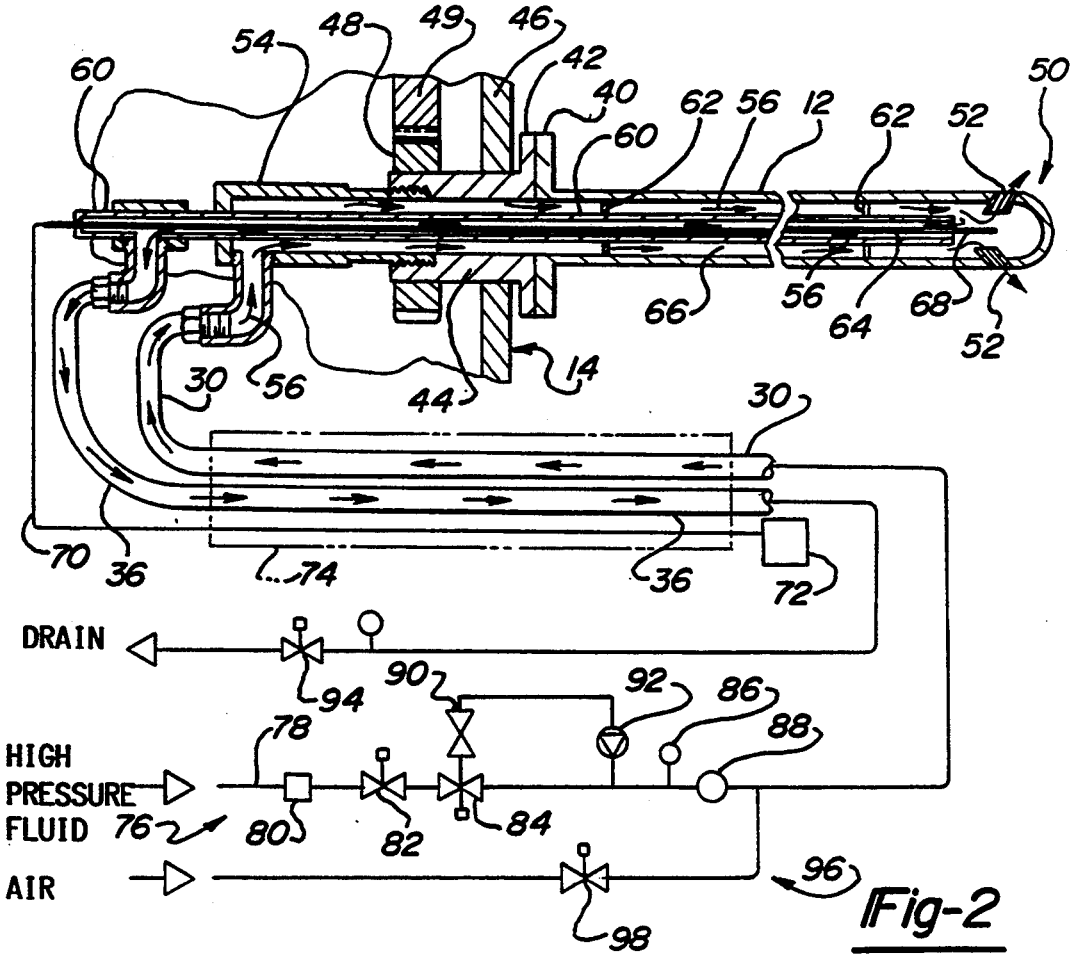
FIG. 2 is a schematic diagram showing the blowing fluid supply to the lance tube and fluid drain according to the present invention.

With reference to FIG. 2, the lance tube fluid supply and fluid return systems are shown in greater detail. Lance tube 12 includes a radial flange 40 at its proximal end coupled to the flange 42 of a lance tube hub 44. The lance tube hub 44 extends through the wall 46 of the carriage assembly and is rotationally driven by spur gears 48 and 49 of the carriage assembly drive train. The lance tube includes at the distal end 50 a pair of nozzles 52 through which jet streams of the blowing medium are discharged from the lance tube 12 for impingement against the heat exchanger surfaces. The inlet supply hose 30 is coupled to the lance tube 12 through a rotary union 54 to supply cleaning fluid to the interior of the lance tube as shown by the arrows 56.

An inner tube 60 extends through the lance tube and terminates near the distal end of the lance tube adjacent to the nozzles 52. The inner tube is supported within the lance tube by a plurality of spacers 62 which provide for fluid flow passed the spacers. The inner tube extends axially beyond the rotary union 54 and proximal end of the lance tube where it is coupled to the flexible return hose 36. The inner tube 60 thus divides the interior of the lance tube into two passages, an inner passage 64 within the inner tube and an outer passage 66 between the inner tube and the interior wall of the lance tube. In the embodiment disclosed, the outer passage is used to supply the blowing medium to the nozzles at the end of the lance tube while the inner passage is used to return a portion of the cooling medium from the lance tube for subsequent discharge outside of the heat exchanger. However, it is to be understood that the flow direction can be reversed with the fluid supply flowing through the inner passage with the return flow in the outer passage. The distal end of the inner tube is open so that the inner and outer passages are in communication with one another within the lance tube. In the embodiment shown, where the nozzles are at the distal end of the lance tube, it is preferable for the inner tube to extend to the distal end of the lance tube whereby the inner and outer flow passages are in communication with one another adjacent to the nozzles so that the supply flow of the blowing medium extends the substantial length of the lance tube before entering the return flow passage of the inner tube 60. If desired, a temperature probe 68 can be placed adjacent to the nozzles in the lance tube with a temperature probe signal wire 70 extending through the inner tube to a signal processor 72.

The supply hose 30, return hose 36 and signal wire 70 are all carried by the cable carrier 74 which carries sufficient lengths of the hoses and wire to accommodate the translation of the carriage assembly along the frame box 16. The supply of blowing medium to the hose 30 is controlled by a flow control system 76. The control system 76 receives a high pressure blowing fluid through inlet 78 which can come from any of a variety of sources including a high pressure pump, plant high pressure fluid supply etc. The incoming fluid is first passed through a strainer 80 to remove particulate contamination. A solenoid valve 82 is used to open and close the system to initiate and terminate the flow of cleaning fluid at the beginning and end of each cleaning cycle.

A three-way solenoid valve 84 is used to switch between low and high pressure as described further below. In its unenergized state, the high pressure side is open, supplying the blowing medium which then passes pressure gauge 86 and pressure switch 88. During periods when the nozzles 52 are directed toward surfaces which need to be clean, high pressure fluid flow is needed.

However, when the nozzles are not directed toward surfaces needing cleaning, such as when directed toward an already cleaned surface or during the non-cleaning stroke of the operating cycle, it is wasteful and potentially damaging to the heat exchanger for continued discharge of cleaning fluid into the boiler. When cleaning is not needed, the three-way valve 84 is energized, whereby the cleaning fluid is diverted through the low pressure side of the control system which includes a reducing valve 90 and a check valve 92. This provides a lower pressure and lower flow rate of the blowing medium to the lance tube for cooling the lance tube. The lower volume flow rate of the blowing medium is sufficient for cooling of the lance tube.

During those non-cleaning portions of the cleaning stroke where a low or reduced amount of blowing medium is being discharged from the nozzles, the rate of rotation and translation of the lance tube can be increased so as to decrease the overall time of the operating cycle. When cleaning is again set to commence, the rate of rotation and translation can then be reduced for maximum cleaning efficiency. During the non-cleaning stroke of the lance tube (which can be either insertion or retraction of the lance tube), the rate of translation can again be increased to its maximum rate to further decrease the overall duration of the operating cycle.

To avoid the undesirable thermal load on the heat exchanger when the cooling flow of the blowing medium is discharged into the heat exchanger, the return hose 36 and inner tube 60 are used to drain a portion of the blowing medium from the lance tube for discharge outside of the heat exchanger. When the valve 84 is energized to reduce the flow rate of the blowing medium, the drain valve 94 is opened allowing flow through the inner tube and return hose 36. The inner tube and return hose provide a parallel flow path for the blowing medium. The relative flow restrictions through the nozzle and the drain will determine the proportion of the blowing medium which is discharged through the nozzles and the portion which is drained from the lance tube. Preferably, the drain has a minimum flow restriction so that a majority of the blowing medium is drained from the lance tube rather than being discharged through the nozzles 52. The flow bypass or drain allows a flow of the blowing medium through the lance tube for cooling or other purposes while avoiding excess discharge of blowing medium into the heat exchanger.

An air inlet 96 is provided and coupled to the supply hose 30 for use in purging condensed blowing medium or water from the lance tube to prevent unwanted dripping of the condensed fluid from the nozzles when the sootblower is not in use. This is necessary for a retractable type sootblower in which, when not in use, the lance tube is positioned externally of the heat exchanger and cools.

A solenoid valve 98 is provided to open and close the air inlet. As the sootblower lance tube is retracted to its nonuse position outside of the heat exchanger, the valve 98 is opened as the valve 82 is closed, introducing air into the supply hose 30 to blow the remaining cleaning fluid from the lance tube. The air inlet 96 can also be used to initially purge condensed blowing medium from the lance tube 12 at a low pressure to prevent the condensate from being discharged against the heat exchanger surfaces where the resulting thermal shock can cause structural damage to those surfaces. Where purging with low pressure air is to be performed, the lance tube 12 may be inserted a distance into the heat exchanger to preheat the lance tube and vaporize the condensate before it is purged from the lance tube. If the condensate is purged at a low enough rate or pressure, preheating may not be necessary. Cleaning can then be performed during the retraction stroke. Alternately, air inlet 96 can provide air to the supply hose 30 at either high or low pressure to be used as the blowing medium itself, as further discussed below.

The sootblower of the present invention thus regulates the amount of the blowing medium being discharged from the lance tube into the heat exchanger by providing a return flow path for draining a portion of the blowing medium from the lance tube. The relative restrictions to fluid flow through the drain and the nozzles will determine the proportion of blowing medium being drained and being discharged into the heat exchanger. The sootblower of the present invention enables the discharge of blowing medium into the heat exchanger to be significantly reduced during periods of a cleaning cycle in which the nozzles are not directed toward surfaces to be cleaned, while at the same time enabling a flow rate of blowing medium through the lance tube sufficient for cooling purposes yet not discharging that entire flow into the heat exchanger but rather draining a portion of that from the lance tube and heat exchanger.

In summary, the present invention provides a sootblower which is intended to perform cleaning during a single pass of the lance tube, either on the insertion or retraction stroke. As seen in 3*a* and 4*a*, during cleaning on the extension stroke, the translational speed is maintained at a reduced speed to optimize cleaning. The rate of discharge of the blowing medium is held at a high rate to also optimize cleaning. Depending on the configuration of the heat exchange surfaces which are to be cleaned, the translational speed and the discharge rate can be accordingly varied during the cleaning stroke so as to increase the speed of the lance tube and decrease the discharge rate of the blowing medium during any non-cleaning periods of the cleaning stroke. After the lance tube has completed the cleaning stroke and reached full extension, the discharge flow rate is decreased to conserve consumption of the blowing medium and the translational speed of the lance tube may be increased so as to reduce the overall time for retraction. If the blowing medium is being supplied at a rate sufficient to cool the lance tube during the non-cleaning stroke, it might prove cost efficient to hold the translational speed of the lance tube constant.

Figure 3A:
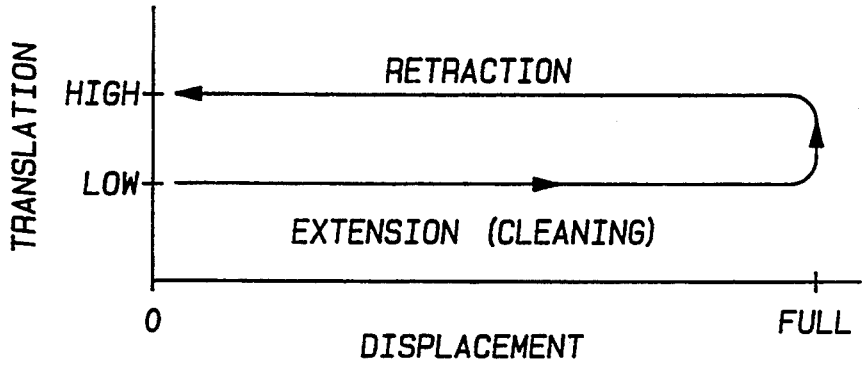
FIG. 3*a* is a translational speed versus displacement diagram generally illustrating changes in translational speed over the course of an operating cycle where cleaning is performed during insertion.
Figure 3B:
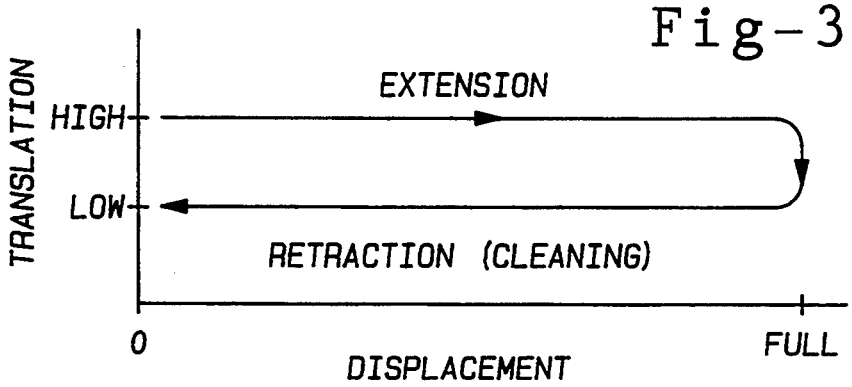
FIG. 3*b* is a translational speed versus displacement diagram generally illustrating changes in translational speed over the course of an operating cycle where cleaning is performed during retraction.
Figure 4A:
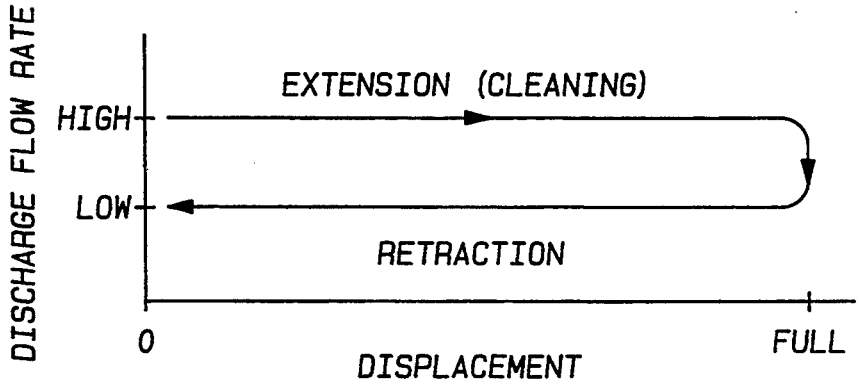
FIG. 4*a* is a discharge flow rate versus displacement diagram generally illustrating changes in discharge rate over the course of an operating cycle where cleaning is performed during insertion.
Figure 4B:
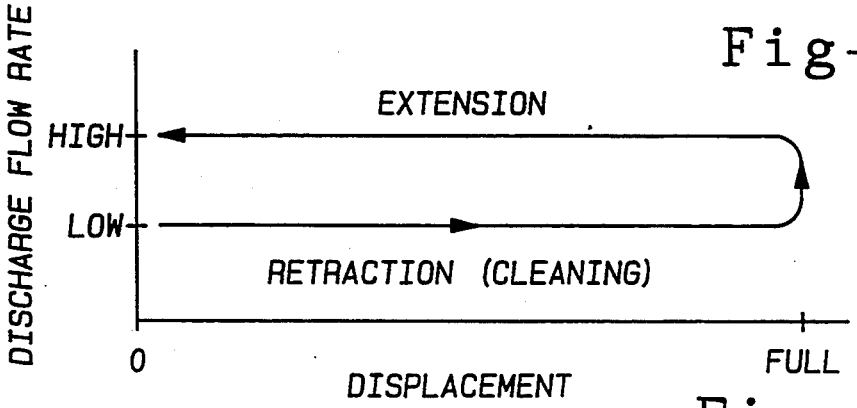
FIG. 4*b* is a discharge flow rate versus displacement diagram generally illustrating changes in discharge rate over the course of an operating cycle where cleaning is performed during retraction.

Obviously, the invention can operate where the retraction stroke of the lance tube is the cleaning stroke of the operating cycle. This is shown in FIGS. 3*b* and 4*b*. Here, during extension, the translational speed is high while the discharge rate is kept low. Once full extension has been reached and cleaning begins, the translational speed of the lance tube is reduced and the discharge rate of the blowing medium is increased. While the translational speed and discharge rate are shown as being constant in the Figures during the cleaning stroke, it is again understood that they could be varied according to the specific heat exchange surface configurations.

The combination of single pass cleaning, varying the speed of the lance tube and varying the rate of blowing medium discharge efficiently allows the sootblower to perform all of its cleaning during a single pass or stroke of the operating cycle. If sufficient cooling is provided, the present invention can achieve single pass cleaning while maintaining the lance tube at a constant speed.

To conserve the consumption of blowing medium in an operating cycle using single pass cleaning, various combinations of blowing mediums and discharge rates can be utilized. For example, steam can be efficiently used as the blowing medium when discharged at a high pressure rate during the cleaning stroke and discharged at a low rate or pressure during the non-cleaning stroke. Generally, so long as the discharge rate during the non-cleaning portion of the operating cycle is sufficient to cool the lance tube, the speed at which the lance tube moves within the heat exchange can remain constant and need not been increased. Another constant speed alternative uses steam, provided at an increased rate, as the blowing medium during cleaning and air through the air inlet 96, at a reduced or low pressure rate, as the blowing medium during the non-cleaning stroke of the operating cycle. If desired, air could be used during both the cleaning and non-cleaning portions of the operating cycle when respectively supplied at an increased and decreased rate through the air inlet 96. Another alternate combination uses water provided at an increased rate as the blowing medium during the cleaning stroke and air, provided at a decreased rate, as the blowing medium during the non-cleaning stroke of the operating cycle.

The net effect of the changes in rotational and translational speeds is that the overall duration of the operating cycle and wear on the lane tube are reduced. Substantial cost savings are also realized through decreased blowing medium being expended during the course of the operating cycle. This in turn results in an increased operating efficiency of the heat exchanger because of the lower thermal load placed on the heat exchanger during non-cleaning situations.

It is to be understood that the invention is not limited to the exact construction illustrated and described above, but that various changes and modifications may be made without departing from the spirit and scope of the invention as defined in the following claims.

Figure 5:
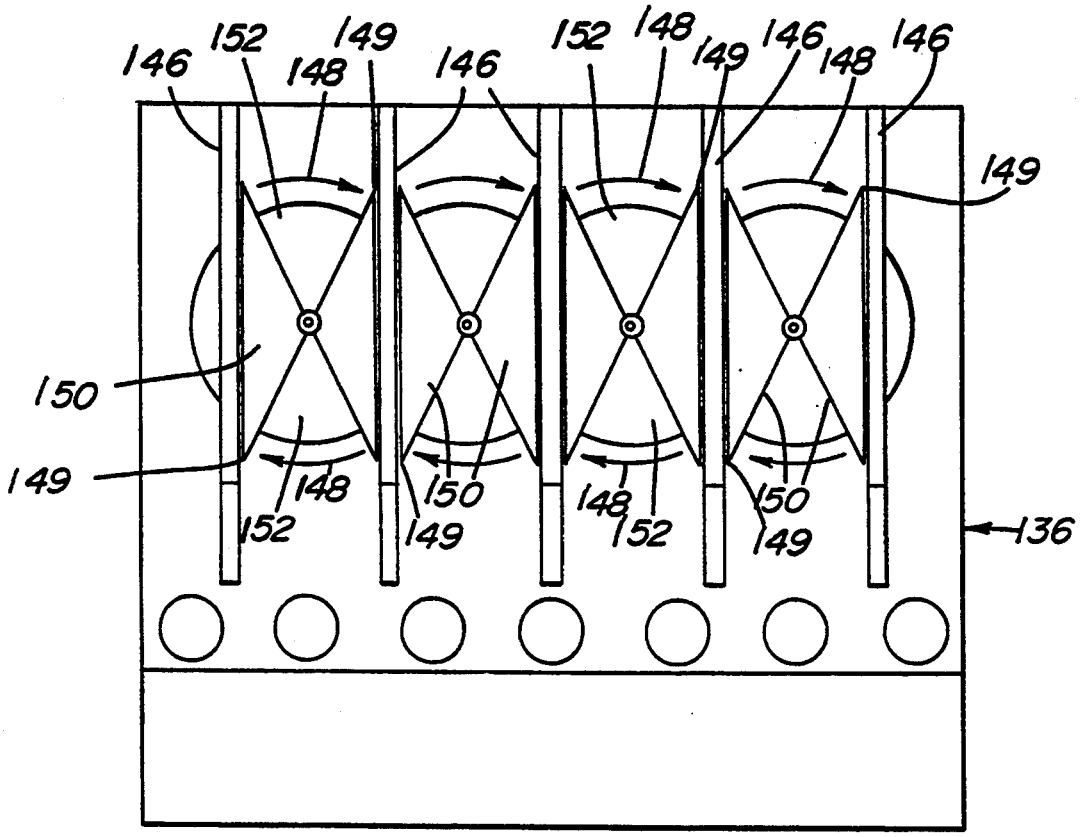
FIG. 5 is a front diagrammatic view illustrating operation of a sootblower in accordance with this invention.

In addition to regulating the flow of blowing medium between extension and retraction of lance tube 12, the rate can be varied during a single rotation of the lance tube. This would be useful where the jet 149 emitted from nozzles 52 strikes a surface to be cleaned over less than a full rotation of the lance tube, for example where cleaning of boiler wing walls is required. Such operation is shown with reference to FIG. 5. Lance tube 12 is being inserted into a boiler 136 along an axis which would extend out of the plane of the drawing. Vertical heated surfaces often referred to as divider walls or wing walls 146 extend generally parallel to one another and to the insertion axis. As the lance tube 12 is inserted and rotated, rotation proceeds in the direction designated by arrows 148. The point of impingement of jet 149 travels up along the surface of one wing wall 146 and than downward along the surface of the immediately adjacent wing wall 146. As is shown in FIG. 5 the jet emitted from nozzles 52 are effectively used for cleaning over the arc designated at 150. However, when the jets are projecting directly in a vertical plane, the blowing medium discharge is not used for cleaning. Arcs 152 designate portions of the rotational travel of the jets over which cleaning is not required or would be ineffective. Accordingly, sootblower 10 is operated to reduce the flow of emitted blowing medium from nozzle 52 during arcs 152 over each rotational cycle as depicted in FIG. 5.

We claim:

1. A retractable sootblower for cleaning of surfaces within a heat exchanger, said sootblower comprising:

a carriage including a hollow lance tube coupled to a drive train connected to motor means for driving said drive train, said drive train causing translation and rotational movement of said lance tube for insertion and retraction of said lance tube within said heat exchanger, said lance tube having at least one discharge nozzle attached to said lance tube and communicating with the interior of said lance tube;

supply means for supplying a pressurized blowing medium to the interior of said lance tube, said blowing medium being discharged through said nozzle; and feed control means for controlling the rate at which said blowing medium is discharged through said nozzle during said movement of said lance tube, said feed control means varying said rate of said blowing medium discharge between an increased rate and a decreased rate, said blowing medium being discharged at said increased rate when said nozzle is directed toward a surface of said heat exchanger and cleaning is to be performed, said blowing medium being discharged at said decreased rate when cleaning is not to be performed, said reduced rate providing sufficient flow of said blowing medium discharge to provide a cooling effect for said lance tube while said lance tube is extended into said heat exchanger.

2. The sootblower of claim 1 wherein said blowing medium is discharged at said increased rate during insertion of said lance tube within said heat exchanger and at said reduced rate during retraction of said lance tube from said heat exchanger whereby the cleaning effect of said sootblower is substantially achieved during said insertion.

3. The sootblower of claim 1 wherein said blowing medium is discharged at said reduced rate during insertion of said lance tube within said heat exchanger and at said increased rate during retraction of said lance tube from said heat exchanger whereby the cleaning effect of said sootblower is substantially achieved during said retraction.

4. A retractable sootblower for cleaning of surfaces within a heat exchanger, said sootblower comprising:

a carriage including a hollow lance tube coupled to a drive train connected to motor means for driving said drive train, said drive train causing translational and rotational movement of said lance tube for insertion and retraction of said lance tube within said heat exchanger, at least one discharge nozzle attached to said lance tube and communicating with the interior of said lance tube:

first supply means for supplying a first blowing medium to the interior of said lance tube, said first blowing medium being discharged through said nozzle to provide a first cleaning effect and providing a flow of said blowing medium at least sufficient for cooling said lance tube while said lance tube is extended within said heat exchanger;

second supply means for supplying a second blowing medium to the interior of said lance, said second blowing medium being discharged through said nozzle to provide a second cleaning effect which exceeds that of said first cleaning effect; and control means for alternately activating said first and second supply means in a predetermining schedule during said movement of said lance tube whereby said first supply means is activated during portions of the cycle of said movement of said lance tube where said second cleaning effect is not required and said second supply means is activated during portions of the cycle of said movement of said lance where said second cleaning effect is required whereby the cleaning effect of said sootblower is substantially achieved through said activation of said second supply means.

5. The sootblower of claim 4 wherein said first and second blowing mediums are steam supplied at different pressures by said first and second supply means.

6. The sootblower of claim 4 wherein said first and second blowing mediums are air supplied at different pressures by said first and second supply means.

7. The sootblower of claim 4 wherein said second blowing medium being discharged during insertion of said lance tube into said heat exchanger for cleaning of the surfaces within the heat exchanger and said first blowing medium being discharged during retraction of said lance tube from said heat exchanger.

8. The sootblower of claim 4 wherein said first blowing medium is air and said second blowing medium is stream.

9. The sootblower of claim 4 wherein said first blowing medium is air and said second blowing medium is water.

10. The sootblower of claim 4 wherein said second blowing medium being discharged during retraction of said lance tube from said heat exchanger for cleaning of the surfaces within the heat exchanger and said first blowing medium being discharged during insertion of said lance tube into said heat exchanger.

11. The sootblower of claim 4 wherein said first blowing medium purges condensate from the interior of the lance tube during a portion of a cleaning cycle of said sootblower thereby reducing damage to the surfaces within the heat exchanger which would be caused by said condensate.

12. A method of operating a sootblower over the course of an operating cycle, said sootblower including a retractable lance tube having at least one nozzle through which blowing medium is discharged in a jet against surfaces of a heat exchanger to clean the heat exchanger surfaces, said method comprising the steps of:

inserting said lance tube into the heat exchanger;

retracting said lance tube out of the heat exchanger;

discharging said blowing medium from said nozzle at a predetermined rate and directing said jet of said blowing medium to impinge against the heat exchanger surfaces thereby cleaning the heat exchanger surfaces;

rotating said lance tube and said nozzle to cause rotation of said jet of said blowing medium; and varying said predetermined rate of blowing medium discharge between an increased cleaning rate and a reduced cooling rate, said increased cleaning rate being provided during at least a portion of either one of said inserting or said retracting steps when said nozzle is directed toward said heat exchanger surfaces and said heat exchanger surfaces are to be cleaned, said reduced cooling rate being provided during the other of said inserting or said retracting steps.

13. The method set out in claim 12 wherein said increased cleaning rate occurs during said inserting step.

14. The method set out in claim 12 said increased cleaning rate occurs during said retracting step.

15. The sootblower of claim 1 further comprises: speed control means coupled to said motor means for causing said movement of said lance tube to be varied at a controlled rate, said speed control means varying said rate of said movement between a reduced movement rate when said blowing medium is being discharged at said increased rate and at an increased movement rate when said blowing medium is being discharged at said decreased rate.

16. The sootblower of claim 1 wherein said feed control means causes said blowing medium to be discharged at said increased rate over one or more arc portions which comprise less than a full rotational revolution of said lance tube and discharged at said reduced rate over other arc portions of said full rotational revolution.

17. The sootblower of claim 4 wherein said first and second blowing mediums are water supplied at different pressures.

18. The sootblower of claim 4 wherein said first blowing medium is steam and said second blowing medium is water.

19. The sootblower of claim 4 wherein said control means causes said first supply means to be activated over one or more arc portions which comprises less than a full rotational revolution of said lance tube and activating said second supply means over other arc portions of said full rotational revolution.

20. A sootblower of claim 4 further comprises speed control means coupled to said motor means for causing said movement of said lance tube to be varied at a controlled rate, said speed control means varying said rate of said movement between a reduced movement rate when said second supply means is activated and at an increased movement rate when said first supply means is activated.

* * * * *